US010979818B2

(12) United States Patent
Zhang et al.

(10) Patent No.: US 10,979,818 B2
(45) **Date of Patent: *Apr. 13, 2021**

(54) SPEAKER WITH HOLDER HAVING ENGAGING GROOVE

(71) Applicant: AAC Technologies Pte. Ltd., Singapore (SG)

(72) Inventors: Guqing Zhang, Shenzhen (CN); Ronglin Linghu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 16/528,654

(22) Filed: Aug. 1, 2019

(65) Prior Publication Data

US 2020/0045470 A1 Feb. 6, 2020

(30) Foreign Application Priority Data

Aug. 5, 2018 (CN) ..... 201821267290.6

(51) Int. Cl.

| | |
|---|---|
| ***H04R 9/06*** | (2006.01) |
| ***H04R 9/02*** | (2006.01) |
| ***H04R 1/02*** | (2006.01) |

(52) U.S. Cl.

CPC ..... *H04R 9/06* (2013.01); *H04R 1/02* (2013.01); *H04R 9/025* (2013.01); *H04R 2400/11* (2013.01); *H04R 2499/11* (2013.01)

(58) Field of Classification Search

None

See application file for complete search history.

(56) References Cited

U.S. PATENT DOCUMENTS

| | | | | |
|---|---|---|---|---|
| 2009/0161905 | A1* | 6/2009 | Konuma | H04R 9/025 381/412 |
| 2009/0232345 | A1* | 9/2009 | Takase | H04R 31/006 381/412 |
| 2020/0045436 | A1* | 2/2020 | Zhang | H04R 9/06 |

* cited by examiner

*Primary Examiner* — Walter F Briney, III

(74) *Attorney, Agent, or Firm* — W&G Law Group LLP

(57) ABSTRACT

A speaker is provided. The speaker includes: a vibration unit; a magnetic circuit unit configured to drive the vibration unit to vibrate and emit sound, and a frame for fixing the magnetic circuit unit. The magnetic circuit unit includes a magnetic frame and a magnet received in the magnetic frame. The magnetic frame comprises a bottom wall connected to the magnet, a side wall formed by extending from the bottom wall while being bent towards the vibration unit, and a positioning boss formed by extending from an outer side of the side wall towards the frame. The positioning boss is positioned to abut against a surface of the frame facing away from the vibration unit. Compared with the related art, the speaker is more convenient in assembling.

8 Claims, 5 Drawing Sheets

A–A

B–B

SPEAKER WITH HOLDER HAVING ENGAGING GROOVE

TECHNICAL FIELD

The present disclosure relates to the field of electric-acoustic conversion technologies, and in particular, to a speaker applied in a portable electronic product.

BACKGROUND

With the advent of the mobile Internet era, the number of smart mobile devices continues to rise. Among the numerous mobile devices, mobile phones are undoubtedly the most common and portable mobile terminal devices. At present, functions of the mobile phones are extremely diverse, one of which is high-quality music. Therefore, speakers for playing sound are widely used in today's smart mobile devices.

In the related art, a speaker includes a frame, and a magnetic circuit unit and a vibration unit that are received in the frame. The magnetic circuit unit is used to drive the vibration unit to vibrate and emit sound. The magnetic circuit unit includes a magnetic frame and a magnet mounted on the magnetic frame and forms a magnetic gap with the magnetic frame. The vibration unit includes a diaphragm for vibrating and emitting sound, and a voice coil. The voice coil has one end connected to the diaphragm and another end inserted into the magnetic gap. By applying a current to the voice coil, the voice coil vibrates by being subjected to the Lorentz force in the magnetic field, and drives the diaphragm to vibrate and emit sound.

However, the speaker in the related art does not have any positioning structure on the magnetic frame, so that it is uneasy to determine a position of the magnetic frame during assembly. Once the assembling position of the magnetic frame is deviated, a relative position between the magnet and the voice coil will change, thereby affecting the sound emission effect of the speaker.

Therefore, it is necessary to provide a new speaker to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
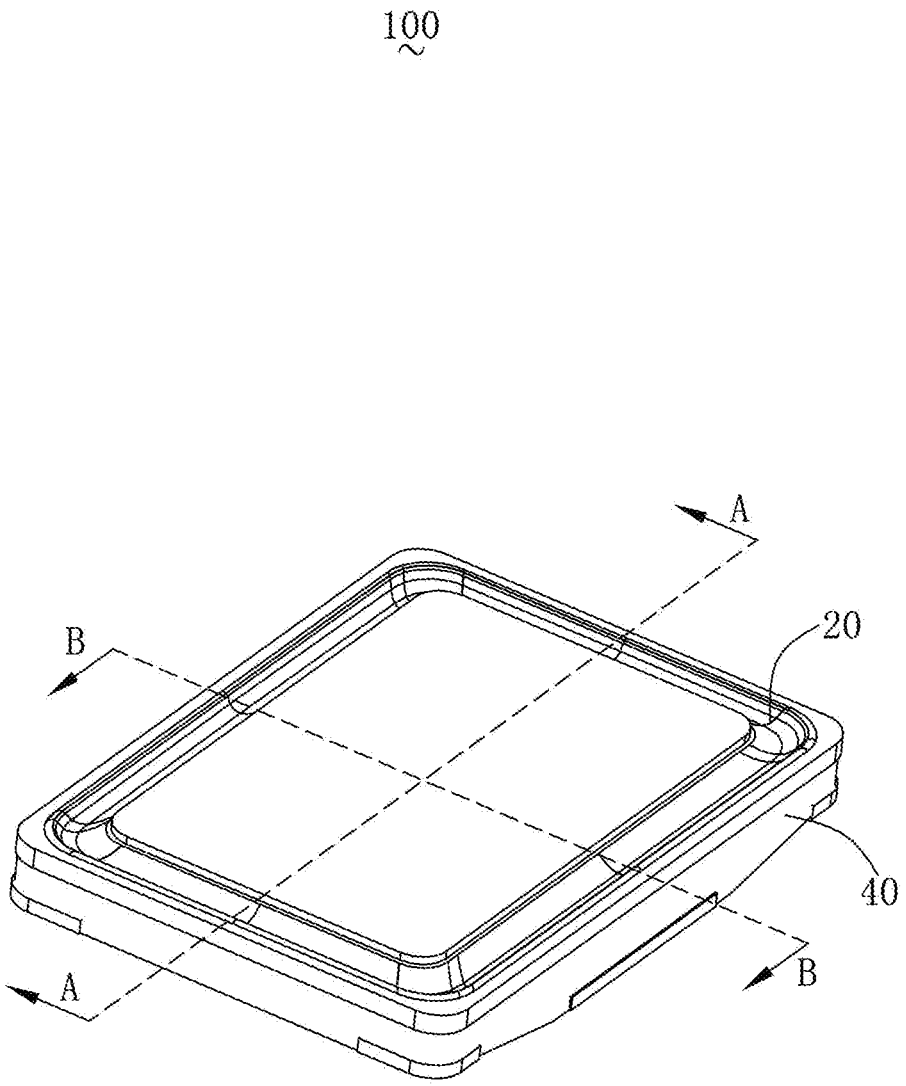
FIG. 1 is a perspective structural schematic diagram of a speaker according to an embodiment of the present disclosure.
Figure 2:
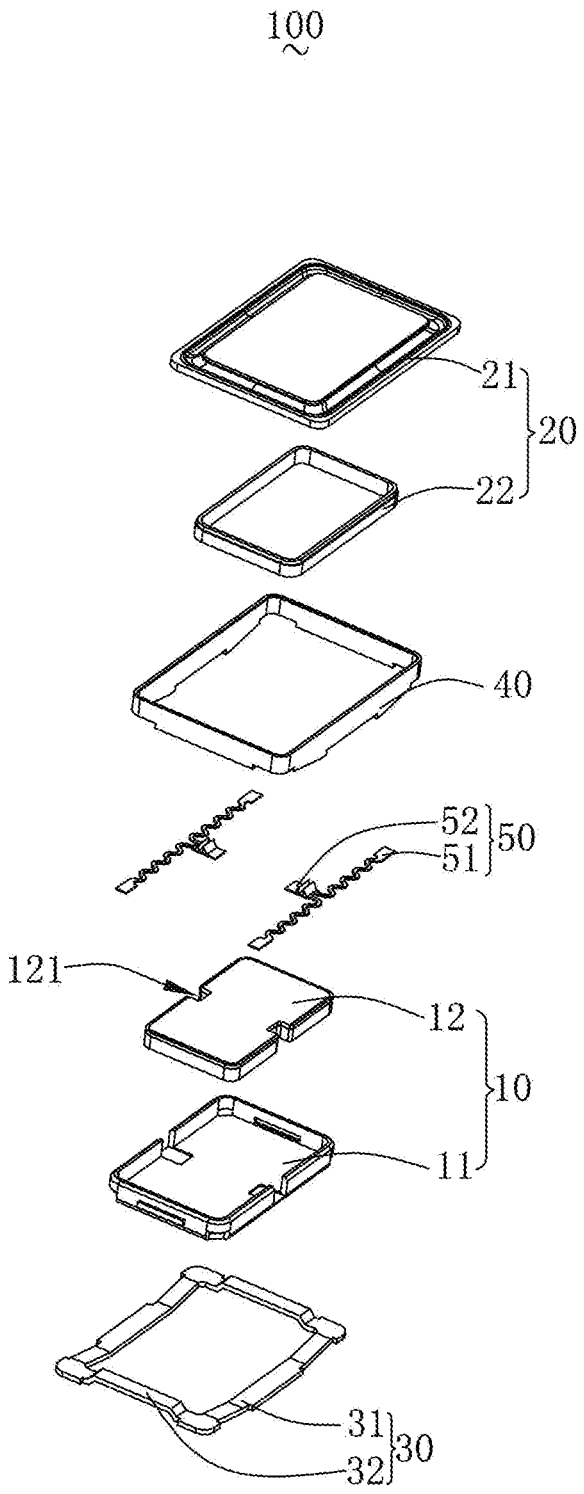
FIG. 2 is a exploded structural schematic diagram of a speaker according to an embodiment of the present disclosure.

Referring to FIG. 1 and FIG. 2, the present disclosure provides a speaker 100. The speaker 100 includes a magnetic circuit unit 10, a vibration unit 20, a frame 30 that fixes the magnetic circuit unit 10, a frame body 40 that fixes the vibration unit 20, and a flexible printed circuit board 50 that is connected to the vibration unit 20. The magnetic circuit unit 10 is used to drive the vibration unit 20 to vibrate and emit sound, and the frame body 40 is sleeved and fixed to an outer side of the frame 30.

The magnetic circuit unit 10 includes a magnetic frame 11 fixed to the frame 30, and a magnet 12 provided in the magnetic frame 11.

Figure 3:
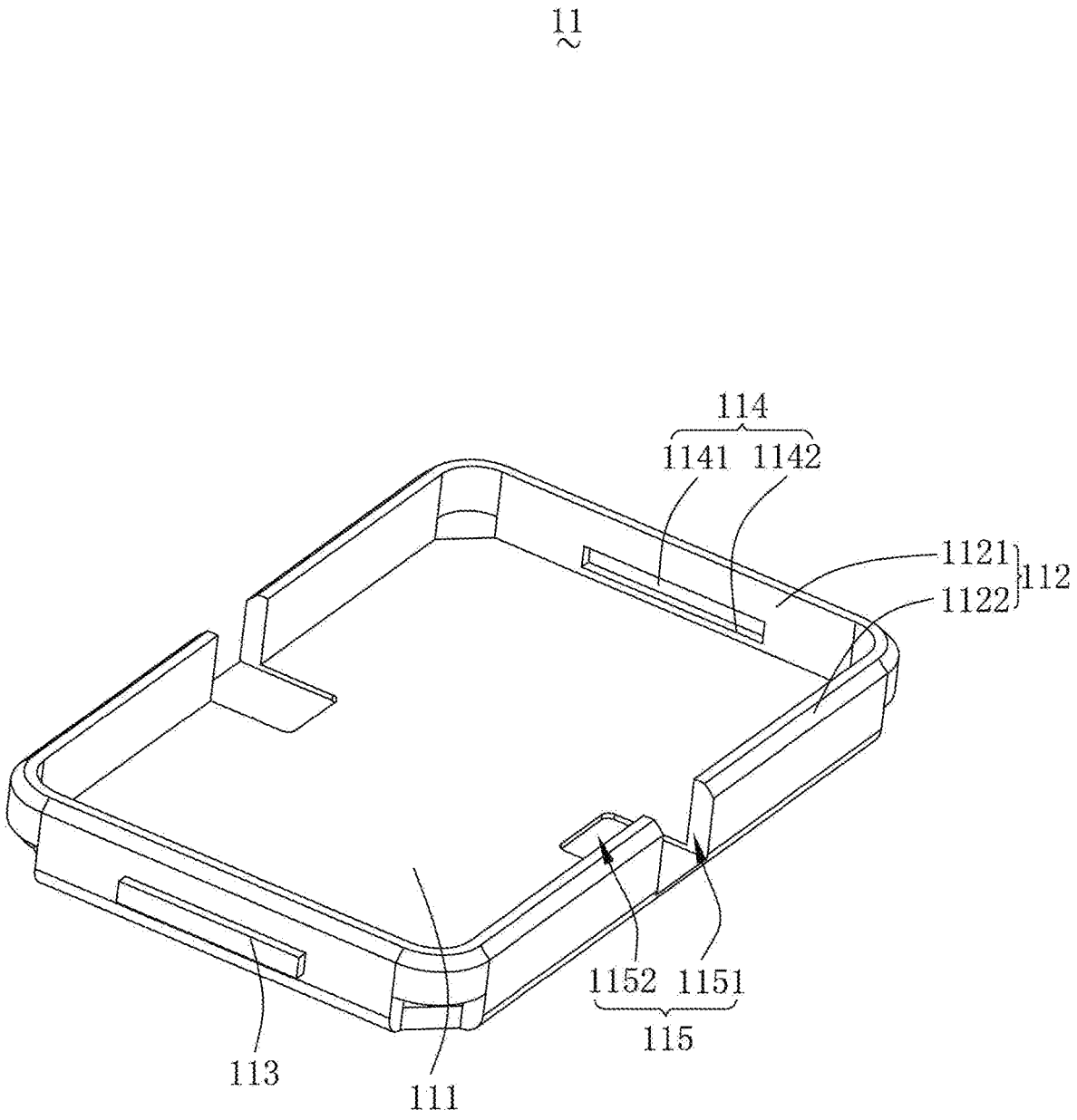
FIG. 3 is a perspective structural schematic diagram of a magnetic frame shown in FIG. 2.
Figure 4:
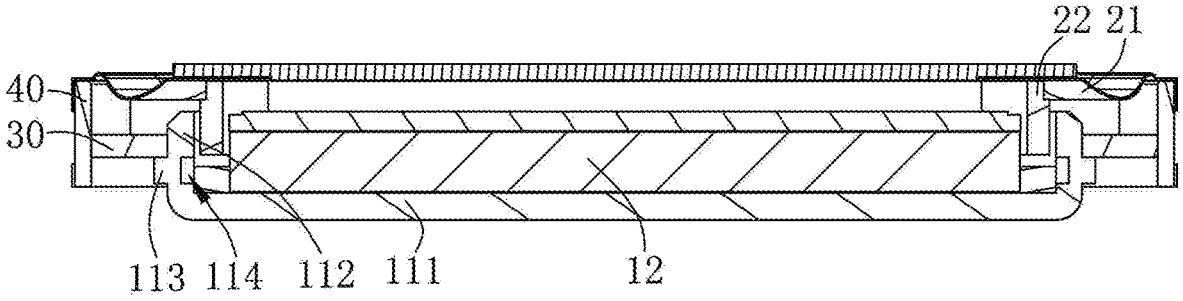
FIG. 4 is a cross-sectional diagram taken along line A-A of FIG. 1.

Referring to FIGS. 3 and 4, the magnetic frame 11 includes a bottom wall 111 connected to the magnet 12, a side wall 112 extending from the bottom wall 111 while being bent towards the vibration unit 20, and a positioning boss 113 formed by extending from the outer side of the side wall 112 towards the frame 30.

The side wall 112 includes a pair of short side walls 1121 arranged opposite to each other and a pair of long side walls 1122 arranged opposite to each other. In this embodiment, two ends of the two short side walls 1121 are respectively connected to the two long side walls 1122. The two short side walls 1121 and the two long side walls 1122 are connected in a head-to-tail manner to enclose a rectangular ring structure. In other embodiments, there may be no connection between the short side walls 1121 and the long side walls 1122, that is, there may be a gap between the short side walls 1121 and the long side walls 1122.

The positioning boss 113 is abutted against a surface of the frame 30 facing away from the vibration unit 20 to determine the position. The positioning boss 113 is a protruded structure die-molded from the side wall 112. In an example, the magnetic frame 11 further includes a groove 114 formed when die-molding the protruded structure. The groove 114 is formed by recessing from the inner side of the side wall 112 towards the positioning boss 113. The groove 114 is provided opposite to the positioning boss 113.

The groove 114 includes a groove bottom wall 1141 facing right towards the magnet 12 and groove sidewalls 1142 extending respectively from the opposite sides of the groove bottom wall 1141 towards the magnet 12. The groove sidewalls 1142 are symmetrically provided on two sides of the groove bottom wall 1141.

The groove side walls 1142 located at two opposite sides of the groove bottom wall 1141 are parallel to each other. A size of the groove 114 corresponds to a shape of the positioning boss 113.

There are two positioning bosses 113 and two grooves 114 provided respectively. The two positioning bosses 113 are respectively located on the two short sidewalls 1121 and symmetrically arranged. The two grooves 114 are respectively provided to correspond to the two positioning bosses 113. Specifically, the positioning boss 113 and the groove 114 are located at an intermediate position of the short sidewall 1121.

It can be understood that the installation difficulty of the magnetic frame 11 is reduced by providing the positioning boss 113, so that it is not easy for the magnetic frame 11 to have deviation when it is mounted on the frame 30. Moreover, the position of the magnetic frame 11 in the direction in which the vibration unit 20 vibrates can be adjusted by changing the position of the positioning boss 113 on the sidewall 112. In addition, the stability of the connection between the magnetic frame 11 and the frame 30 is also increased by providing the positioning boss 113.

Figure 5:
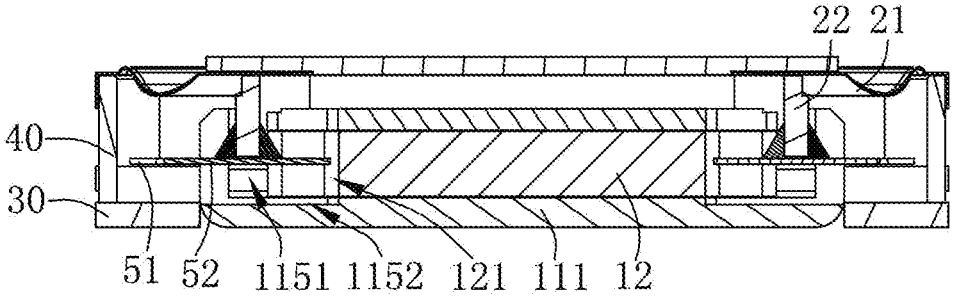
FIG. 5 is a cross-sectional diagram taken along line B-B of FIG. 1.

Referring to FIG. 3 and FIG. 5, the magnetic frame 11 further includes notches 115 provided on the magnetic frame 11. There are two notches 115 provided. The two notches 115 respectively correspond to an intermediate position of the long side wall 1122.

The notch 115 includes a first portion 1151 extending through the long side wall 1122 and a second portion 1152 formed by recessing from the bottom wall 111. The first portion 1151 is in communication with the second portion 1152. The second portion 1152 is formed by recessing from a side of the bottom wall 111 close to the vibration unit 20 in a direction facing away from the vibration unit 20.

Referring to FIG. 2, the magnet 12 is spaced apart from the side wall 112 to form a magnetic gap.

The magnet 12 is provided with an avoiding groove 121 formed by recessing from a side of the magnet 12 close to the side wall 112 in a direction facing away from the side wall 112. There are two avoiding grooves 121 provided. The two avoiding grooves 121 face right towards the two first portions 1151. The orthographic projections of the two avoiding grooves 121 on the bottom wall 111 coincide with the second portion 1152.

The vibration unit 20 includes a diaphragm 21 used to vibrate and emit sound and a voice coil 22 for driving the diaphragm 21 to vibrate. The diaphragm 21 is fixedly connected to the frame body 40, and the voice coil 22 is inserted into the magnetic gap.

The frame 30 is fixedly connected to the frame body 40 and provided on a side of the frame body 40 facing away from the vibration unit 20. The frame 30 includes two long axis sides 31 and two short axis sides 32 connecting the two long axis sides 31. The two short axis sides 32 respectively abut against the side of the two positioning bosses 113 close to the diaphragm 21, i.e., the positioning boss 113 abuts against a surface of the short axis side 32 facing away from the diaphragm 21.

Specifically, the long axis side 31 and the short axis side 32 are located on different planes. In this embodiment, along a direction from the bottom wall 111 to the diaphragm 21, the short axis side 32 is provided above the long axis side 31. Specifically, a distance between the vibration unit 20 and a side of the short axis side 32 abutting against the positioning boss 113 is smaller than a distance between the vibration unit 20 and the long axis side 31.

The frame body 40 has a rectangular ring structure.

The flexible circuit board 50 is connected to the voice coil 22 for communicating the voice coil 22 with an external circuit.

The flexible circuit board 50 is received in a space enclosed by the frame body 40 and the frame 30 and abuts against the frame 30.

The flexible circuit board 50 includes a body portion 51 and an extension portion 52. The body portion 51 abuts against the frame 30. The extension portion 52 extends from the body portion 51 towards the voice coil 22 and is connected to the voice coil 22. In one embodiment, there are two flexible circuit boards 50 provided. The two body portions 51 respectively face right towards the two long side walls 1122. The two extension portions 52 are respectively inserted into the two notches 115, extend into the two avoiding grooves 121 and then are respectively connected to the voice coil 22.

Compared with the related art, with the speaker provided by the present disclosure, the positioning boss is provided at a side wall of the magnetic frame and abuts against the frame, so that when the magnetic frame is being assembled, the mounting position of the magnetic frame is more easily determined, which reduces the installation difficulty of the magnetic frame so that it is not easy to have deviation in the installation position of the yoke, thereby improving the sound emission effect of the speaker; and moreover, the position of the magnetic frame in the direction in which the vibration unit vibrates can be adjusted by adjusting the position of the positioning boss on the sidewall.

The above merely are the embodiments of the present disclosure, and it should be noted that those skilled in the art also can make improvements, without departing from the creative conception of the present disclosure, which all shall fall within the scope of the present disclosure.

What is claimed is:

1. A speaker, comprising:

a vibration unit;

a magnetic circuit unit configured to drive the vibration unit to vibrate and emit sound, and a frame for fixing the magnetic circuit unit, wherein the magnetic circuit unit comprises a magnetic frame and a magnet received in the magnetic frame, the magnetic frame comprises a bottom wall connected to the magnet, a side wall formed by extending from the bottom wall while being bent towards the vibration unit, and a positioning boss formed by extending from an outer side of the side wall towards the frame, and the positioning boss is positioned to abut against a surface of the frame facing away from the vibration unit; and the magnetic frame further comprises a groove formed when the protruded structure is being die-molded, the groove being opposite to the positioning boss.

2. The speaker as described in claim 1, wherein the positioning boss is a protruded structure die-molded from the side wall.

3. The speaker as described in claim 1, wherein the side wall comprises a pair of short side walls arranged opposite to each other and a pair of long side walls arranged opposite to each other, the two long side walls and the two short side walls are connected, head to tail, to form the side wall, and the positioning boss is provided at a side of one of the two short side walls close to the frame.

4. The speaker as described in claim 3, wherein two positioning bosses are provided, and the two positioning bosses are respectively provided on the two short side walls symmetrically.

5. The speaker as described in claim 1, wherein the frame comprises two long axis sides arranged opposite to each other and two short axis sides connecting the two long axis sides, and the positioning boss abuts against one of the two short axis sides.

6. The speaker as described in claim 5, wherein the two short axis sides and the two long axis sides are located in different planes, and a distance between a side of the one of the two short axis sides abutting against the positioning boss and the vibration unit is smaller than a distance between the two long axis sides and the vibration unit.

7. The speaker as described in claim 1, wherein the groove comprises a groove bottom wall facing right towards the magnet and groove side walls respectively extending from two opposite sides of the groove bottom wall towards the magnet, and the groove side walls are symmetrically provided at two sides of the groove bottom wall.

8. The speaker as described in claim 7, wherein the groove side walls located at two opposite sides of the groove bottom wall are parallel to each other, and a size of the groove corresponds to a shape of the positioning boss.

* * * * *